US005548882A

United States Patent [19]

Windhaus et al.

[11] Patent Number: 5,548,882

[45] Date of Patent: Aug. 27, 1996

[54] STORAGE OVEN FOR THIN SLAB CASTING

[75] Inventors: Ernst Windhaus, Duisburg; Bernard Seiler, Mülheim; Peter Meyer, Duisburg; Peter Erwig, Essen; Horst W. Mathejka, Dortmund; Heinrich Patalon, Bochum; Peter Holz, deceased, late of Essen, all of Germany, by Hannelore Holz, heir

[73] Assignee: Didier OFU Engineering GmbH, Essen, Germany

[21] Appl. No.: 167,933

[22] Filed: May 18, 1994

[30] Foreign Application Priority Data

Jun. 25, 1991 [DE] Germany ..... 41 21 489.7

[51] Int. Cl.[6] ..... B23P 23/06; B21B 1/46; B22D 47/00

[52] U.S. Cl. ..... 29/336; 29/527.7; 164/417

[58] Field of Search ..... 29/33 P, 33 C, 29/527.7; 164/417, 418, 270.1; 72/200, 202; 432/121

[56] References Cited

U.S. PATENT DOCUMENTS

| | | | |
|---|---|---|---|
| 4,976,024 | 12/1990 | Kimura | 29/33 C X |
| 5,014,412 | 5/1991 | Nobis et al. | 29/522.7 |
| 5,329,688 | 7/1994 | Arved et al. | 29/527.7 |
| 5,430,930 | 7/1995 | Passoni et al. | 29/33 C X |
| 5,433,264 | 7/1995 | Dorigo et al. | 164/417 |

FOREIGN PATENT DOCUMENTS

| | | | |
|---|---|---|---|
| 3105064 | 9/1982 | Germany . | |
| 89502 | 4/1987 | Japan | 29/527.7 |
| 63-76701 | 4/1988 | Japan . | |
| 6198304 | 7/1994 | Japan | 29/527.7 |

*Primary Examiner*—William Briggs
*Attorney, Agent, or Firm*—Cohen, Pontani, Lieberman, Pavane

[57] ABSTRACT

The invention is directed to an oven installation as intermediate storage between the non-mandrel type coiling device for the strip-shaped slab located downstream of a thin-slab casting installation and its uncoiling device corresponding to the rolling mill downstream. In order to provide an oven installation between the coiling device and uncoiling device for the cast slab which enables a reheating of the bundles, if necessary, in addition to favorable heating conditions for the cast material and which provides a large storage capacity upstream of the rolling mill, the invention proposes the use of a circulating pallet system having pallet cars (9) which can be transported cyclically through the oven (11) and can be displaced transversely (8, 13) at the input and output of the oven and guided back (17) laterally alongside the oven, and the platforms of the pallet cars (9), which are made from refractory material and whose end sides directly abut at one another, form the hearth bottom of the oven (11) and are provided with saddles produced from material with poor thermal conductivity for receiving the slab bundles.

10 Claims, 1 Drawing Sheet

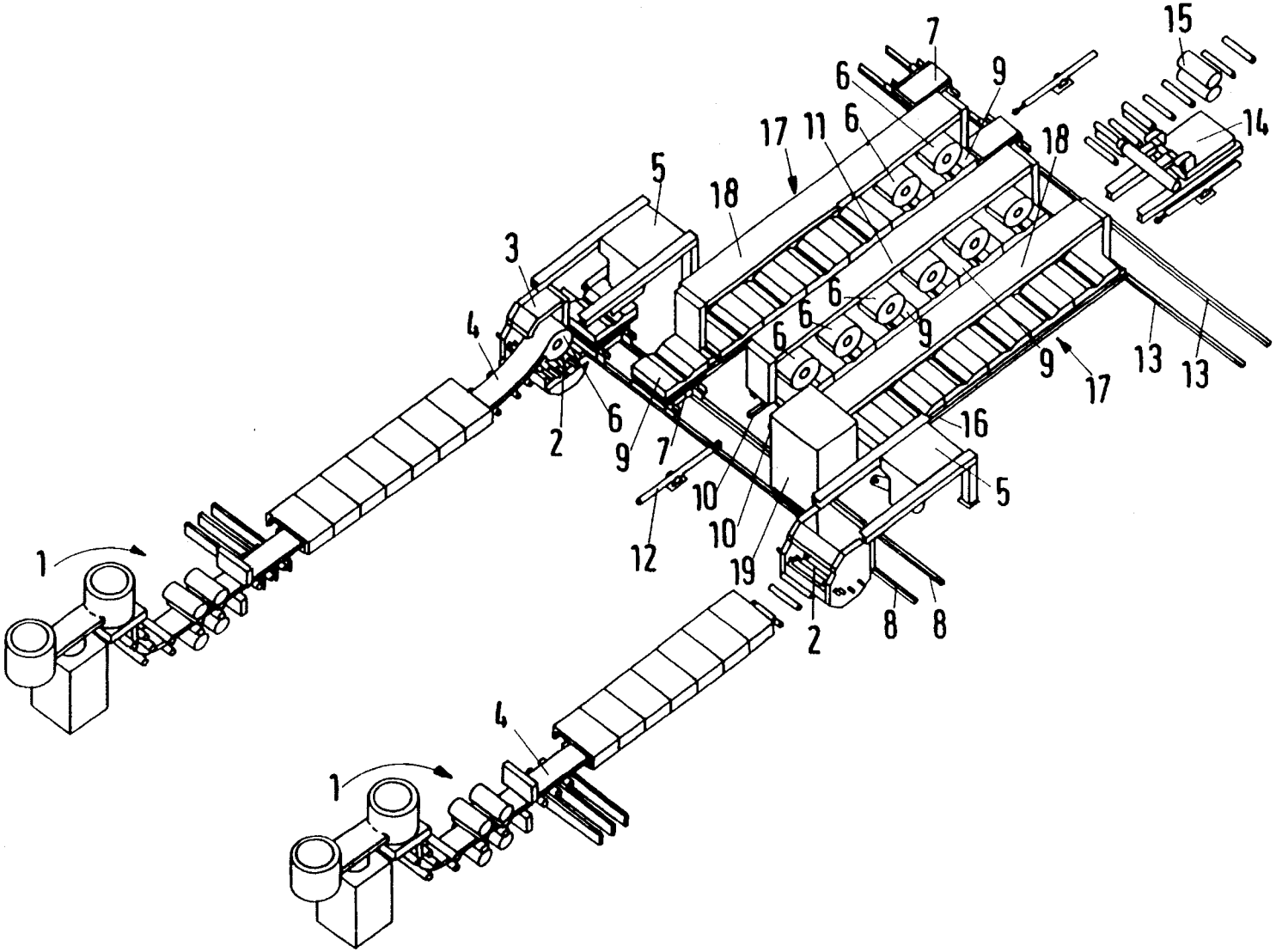
1
1
2
2
3
4
4
5
5
6
6
6
6
7
7
8
8
9
9
9
9
10
10
11
12
13
13
14
15
16
17
17
18
18
19

STORAGE OVEN FOR THIN SLAB CASTING

BACKGROUND OF THE INVENTION

The invention is directed to an oven installation as intermediate storage between the non-mandrel type coiling device for the strip-shaped slab located downstream of a thin-slab casting installation and its uncoiling device corresponding to the rolling mill downstream.

A process and a device for producing hot-rolled strip steel from continuous-cast primary material are known from the German Offenlegungsschrift 32 41 745. In this process and device the strip-shaped slab is formed into a bundle in a coiling device. After the bundle weight is reached, the bundle is guided into an oven constructed as an intermediate storage. At the same time, the bundle which is transferred from the coiling device to the uncoiling device located downstream is preferably kept hot or reheated by this oven so that the casting heat is substantially maintained.

In this way, the prior art attempts to solve the problem of in-line rolling of primary material continuously emerging from the continuous casting installation. The problem consists in that the maximum casting speed at which the slab emerges from the continuous casting installation is much lower than the lowest possible rolling speed of a conventional roll stand. This problem can be offset if the slab is coiled in a bundle, severed at a desired length, and then uncoiled again for insertion into the rolling mill. Accordingly, it is possible to maintain different speeds in that a buffer zone is created between the continuous casting installation and the rolling mill.

Another problem in such installations consists in that periods of disruption which can occur in the rolling mill downstream of the thin-slab casting installation must also be offset in addition to the different coiling and uncoiling speeds of the bundles. Time required for conversion and maintenance work in the rolling mill must also be offset.

SUMMARY OF THE INVENTION

The object of the present invention is to provide an oven installation between the coiling and uncoiling devices for the slab which enables a reheating of the bundles, if necessary, in addition to favorable heating conditions for the cast material and which provides a large storage capacity upstream of the rolling mill.

According to the invention, the oven installation is characterized by a circulating pallet system having pallet cars (pusher-type hearth cars) which can be transported cyclically through the oven and can be displaced transversely at the input and output of the oven and guided back laterally alongside the oven. The platforms of the pallet cars whose end sides directly abut one another are provided with saddles produced from a material with poor thermal conductivity for receiving the slab bundles.

The suggested circulating pallet car system provides a transporting device for the slab bundles in which the risk of deformation of the bundles by the transporting means is very low, since these bundles are safely guided in saddles. There is hardly any flow of heat from the slab bundle to the transporting system as the receiving saddles are produced from material with poor thermal conductivity, e.g. ceramic. This prevents the bundle segments from cooling off, which cannot be permitted if the bundles are to be further processed. A particular advantage of the invention consists in that the pallet system and its necessary return of the pallets makes it possible for the pallets to carry the cast slab bundles in the returning region also so that, in addition to the actual oven, the returning region of the pallets can also be used as an intermediate storage for the cast slab bundles. Since the circulating pallet system forms a closed circuit, the bundles stored in the returning region can be reintroduced into the oven until the rolling mill downstream is again ready to operate.

An advantageous development of the invention provides that the pallet cars can be pushed onto transfer cars for the transverse displacement of the pallet cars, these transfer cars being in turn displaceable on pathways transversely to the pathway of the pallet cars. The pallet cars and the transversely transporting transfer cars are preferably movable on rails. The transfer cars form the transverse connection between the uncoiling station or coiling station and the oven as well as the returning region of the pallet cars.

According to another feature of the invention, a manipulating mechanism which grasps the bundle and is movable between the coiling device and uncoiling device and the pallet cars is provided for transferring the coiled slab bundles to the pallet car and for the transfer from the pallet car to the uncoiling device. The slab bundle which is coiled and severed according to its weight is grasped by means of the manipulating mechanism and lifted out of the coiling device. By moving the manipulating mechanism into the region of the pallet cars arranged on the transfer cars, the bundle can be deposited on the pallet cars or their saddles and guided into the open oven by the transverse movement of the transfer car and displacement of the pallet car in the throughput direction of the oven. By arranging a plurality of pallet cars one after the other with their end sides abutting so that their platforms form a closed hearth bottom of the oven, all of the pallet cars located in the oven are simultaneously moved up by one position when the pallet car loaded with the coiled slab bundle is pushed into the oven and the last pallet car is pushed out of the open oven output door onto a transfer car arranged at this location. Subsequent pallet cars are handled in the same way. The manipulating mechanism on the oven output side grasps the pushed out or, as the case may be, transversely shifted bundle and transfers it to the uncoiling device upstream of the rolling mill.

In a particularly advantageous construction of the invention, the region of the oven installation provided for the return of the pallet cars is enclosed. According to this suggestion, the returning path or return rails for the pallets running laterally alongside the oven are provided with a heating hood, for example, so that slab bundles which cannot be taken over by the rolling mill or uncoiling device can be stored here. However, the enclosure is also important for the return of empty pallet cars, since it prevents a cooling of the saddles receiving the bundles.

According to a further feature of the invention, the housing can be thermally insulated or can also be heated.

In multiple-strand thin-slab casting installations, the oven is preferably arranged in line with the rolling mill and a transport path for returning pallet cars is arranged on each side of the oven.

In single-strand thin-slab casting installations, the oven and the rolling mill can be arranged in a line. The pallet cars are returned via a bypass. Naturally, the arrangement for multiple-strand casting installations can be selected for single-strand thin-slab casting installations so as to enable subsequent conversion to double casting operation.

BRIEF DESCRIPTION OF THE DRAWING

An embodiment of the invention is shown in the single feature.

DETAILED DESCRIPTION OF THE PREFERRED EMBODIMENTS

The drawing shows the thin-slab casting installation 1 which is located downstream of a shaping unit, oscillating or pendulum shears, and the dummy or start-up bar pull-out mechanism. The coiling device 12 for the strip-shaped slab 4 addressed by the invention is located downstream of an induction oven or other heating system. This coiling device 2 operates without a mandrel and is arranged in a housing 3 which prevents the slab 4 from cooling off. The coiling station can be heated.

The thin-slab casting installation 1 shown in the illustrated embodiment is a double-strand installation. Since identical parts are provided with the same reference numbers, only one strand is referred to.

A manipulating mechanism 5 for the slab bundle 6 is provided directly in the strip running direction downstream of the coiling device 2. The manipulating mechanism 5 is displaceable between the coiling device 2 and the transfer car 7 which is movable on running rails 8 arranged transversely to the thin-slab casting installation 1. At the same time, the running rails 8 connect the coiling devices 2 of the two thin-slab casting installations 1. Two transfer cars 7 are provided. Pallet cars 9 are arranged on the transfer cars 7 in such a way that the pallet cars are displaceable transversely to the running rails 8 of the transfer cars 7. Running rails 10 are arranged inside the oven 11 in the displacement direction of the pallet cars 9 so as to be aligned with corresponding running rails (not shown) on the transfer car 7 so that the pallet cars 9 can be pushed into the open doors of the oven 11 by the transfer cars 7 by means of a pushing device 12. A plurality of pallet cars 9 can move one after the other inside the oven 11 on the running rails 10 and the pallet cars 9 form the hearth bottom of the oven 11 with their directly adjoining platforms. When a pallet car 9 is pushed into the front portion of the oven 11, another pallet car 9 is pushed out of the rear portion of the oven 11 at the same time. A transfer car 7 is likewise positioned at the rear portion of the oven 11 and is also movable transversely to the thin-slab casting installation 1 on a pathway 13. The pallet car 9 which is pushed out of the oven 11 with the slab bundle 6 supported thereon is deposited on the transfer car 7 and can be moved with the latter into a position in which the slab bundle 6 can be taken over by the uncoiling device 14.

In this way, the two coiling devices 2 downstream of the thin-slab casting installation 1 can transfer their slab bundles 6 to the oven 11 from which the bundles 6 are transferred to the rolling mill 15, possibly after reheating. After the slab bundles 6 are transferred by the transfer device of the uncoiling station 14, the pallet cars 9 with the transfer cars 7 are brought into alignment with the running paths 16 of the returning device 17 and are transported back to the first transverse conveying system 8 cyclically in the same way, but in the reverse direction.

In the event of disruptions in the rolling mill 15 which make it impossible to uncoil the bundles 6, the invention provides that the pallet cars 9 with the slab bundles 6 supported thereon are transported into the region of the returning device 17 of the oven installation and are returned to the first transverse conveying system 8 through the oven 11 opposite to the throughput direction. In this way, the bundles 6 can be intermediately stored and the heating hood 18 provided over the returning device 17 prevents excessive cooling of the bundles 6. By transporting the pallet cars 9 crosswise on the transfer cars 7 of the first transverse conveyor 8, the pallet cars 9 can be guided to the oven 11 again and accordingly stored in the circuit.

In the event of more severe disruptions, the two returning devices 17 shown in the drawing can be used for storing the bundles 6 so that even lengthy disruptions can be offset.

In case the returned slab bundles 6 must remain on a transfer car 7 in the rolling position, a warming hood 19 can be placed over the slab bundle 6 so as to prevent it from cooling off excessively.

We claim:

1. An oven installation as intermediate storage between a non-mandrel type coiling device for a strip-shaped slab located downstream of a thin-slab casting installation and an uncoiling device corresponding to a downstream rolling mill, comprising: an oven having an input and an output; and pallet circulating means including pallet cars transportable cyclically through the oven and displaceable transversely at the input and output of the oven and guidable back laterally in a region alongside the oven, the pallet cars having platforms made of refractory material and end sides that directly abut one another so as to form a hearth bottom of the oven, the platforms each further having a saddle produced from a material with poor thermal conductivity, in which saddle a coiled slab bundle is receivable.

2. An oven insulation according to claim 1, and further comprising transfer cars displaceable on pathways transversely to the pathway of the pallet cars, the pallet cars being pushable onto the transfer cars for the transverse displacement of the pallet cars.

3. An oven installation according to claim 2, and further comprising rails which define the pathways of the pallet cars and the transfer cars, the pallet cars and the transfer cars being movable on the rails.

4. An oven installation according to claim 1, and further comprising manipulating means for grasping a coiled slab bundle anti transferring the bundle to a pallet car and for transferring the slab bundle from the pallet car to the uncoiling device, the manipulating means being movable between the coiling device, the uncoiling device and the pallet cars.

5. An oven installation according to claim 1, and further comprising means for enclosing the region provided alongside the oven for return of the pallet cars.

6. An oven installation according to claim 5, wherein the enclosing means includes a housing that is at least one of thermally insulated and heatable.

7. An oven installation according to claim 1, wherein the oven is arranged in line with the rolling mill in a multiple-strand thin-slab casting installation, and further comprising a transport path provided on each side of the oven for returning the pallet cars.

8. An oven installation according to claim 1, wherein the oven and the rolling mill are arranged in one of a line and a Z-shape in a single-strand thin-slab casting installation, and further comprising a bypass pathway for returning the pallet cars.

9. An oven installation according to claim 2, and further comprising a warming hood placeable on the pallet cars which are pushed onto the transfer cars so as to cover the coiled slab bundle.

10. An oven installation according to claim 2, and further comprising means for pushing the pallet cars onto the transfer cars.

* * * * *

UNITED STATES PATENT AND TRADEMARK OFFICE

CERTIFICATE OF CORRECTION

PATENT NO. : 5,548,882

DATED : August 27, 1996

INVENTOR(S) : Ernst WINDHAUS, et al.

It is certified that error appears in the above-indentified patent and that said Letters Patent is hereby corrected as shown below:

On title page, item [73] should read:

Assignee:

Mannesmann Aktiengesellschaft
Düsseldorf, Germany and

Didier OFU Engineering GmbH
Essen, Germany

UNITED STATES PATENT AND TRADEMARK OFFICE

CERTIFICATE OF CORRECTION

PATENT NO. : 5,548,882

DATED : August 27, 1996

INVENTOR(S) : Ernst WINDHAUS, et al.

It is certified that error appears in the above-indentified patent and that said Letters Patent is hereby corrected as shown below:

Add item

| | |
|---|---|
| [22] PCT Filed: | June 25 1992 |
| [86] PCT No.: | PCT/DE92/00527 |
| §371 Date: | 24 Oct 1994 |
| §102(e) Date: | 24 Oct 1994 |
| [87] PCT Pub. No.: | WO 93/00179 |
| [87] PCT Pub. Date: | January 7 1993 |

Signed and Sealed this

Seventeenth Day of June, 1997

*Attest:*

*Attesting Officer*

BRUCE LEHMAN

*Commissioner of Patents and Trademarks*